United States Patent [19]

Davis

[11] 4,181,078

[45] Jan. 1, 1980

[54] AUTOMATIC RECIRCULATING DUPLICATOR

[75] Inventor: William A. Davis, Wickliffe, Ohio

[73] Assignee: AM International, Inc., Los Angeles, Calif.

[21] Appl. No.: 858,682

[22] Filed: Dec. 8, 1977

[51] Int. Cl.[2] ..... B41M 5/00; B41L 21/06; B41F 13/64

[52] U.S. Cl. ..... 101/426; 101/90; 101/240; 271/3.1

[58] Field of Search ..... 101/91, 141, 142, 144, 101/145, 136, 137, 232, 238, 90, 240, 426; 271/3.1, 4, 163; 355/23-25

[56] References Cited

U.S. PATENT DOCUMENTS

| | | | |
|---|---|---|---|
| 3,034,427 | 5/1962 | Ostwald | 101/144 |
| 3,615,129 | 10/1971 | Drawe et al. | 355/26 X |
| 3,627,312 | 12/1971 | Fackler et al. | 271/221 |
| 3,987,722 | 10/1976 | Goodwin | 101/141 X |
| 3,989,236 | 11/1976 | Komori et al. | 271/4 |
| 3,999,852 | 12/1976 | Katayama et al. | 101/470 X |
| 4,080,060 | 3/1978 | Nothmann | 101/142 X |

*Primary Examiner*—Paul T. Sewell
*Attorney, Agent, or Firm*—Michael A. Kondzella; George Jameson; Russell L. Root

[57] ABSTRACT

There is provided an improved automatic recirculating duplicator adapted for duplicating from a master or plate selectively onto one or both sides of paper sheets. It is characterized by a single printing couple. Sheets are fed from a paper table to a printing nip between a printing cylinder and an impression cylinder for printing on the first side and, through operation of a controlled gripping and stripping apparatus, the sheets are turned about the impression cylinder for collection with the printed sides down on a paper tray. The paper tray is then shifted to the feeding location normally occupied by the paper table, and the gripping and stripping apparatus is reset for feeding the sheets, now printed on both sides, directly to an exterior receiver. When it is desired to pint sheets on one side only, the mechanism is set for feeding sheets from the paper table, but manual controls permit resetting the gripping and stripping mechanism to feed sheets directly to the receiver instead of inverting them and sending them to the paper tray.

7 Claims, 16 Drawing Figures

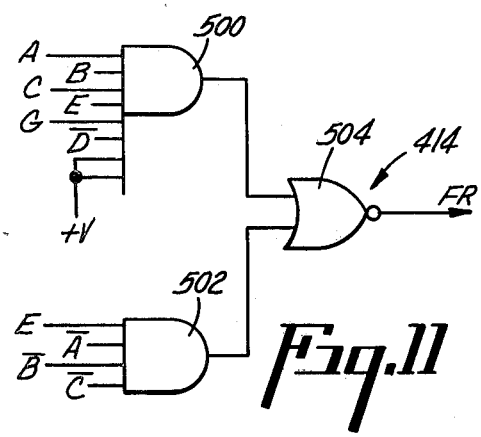
Fig.11
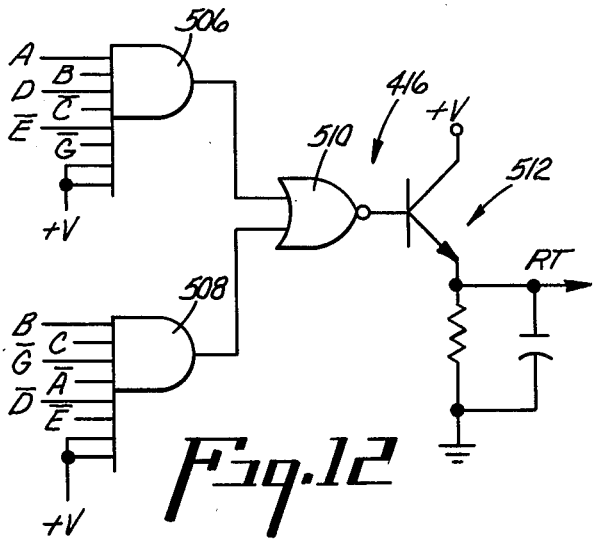
Fig.12
Fig.13
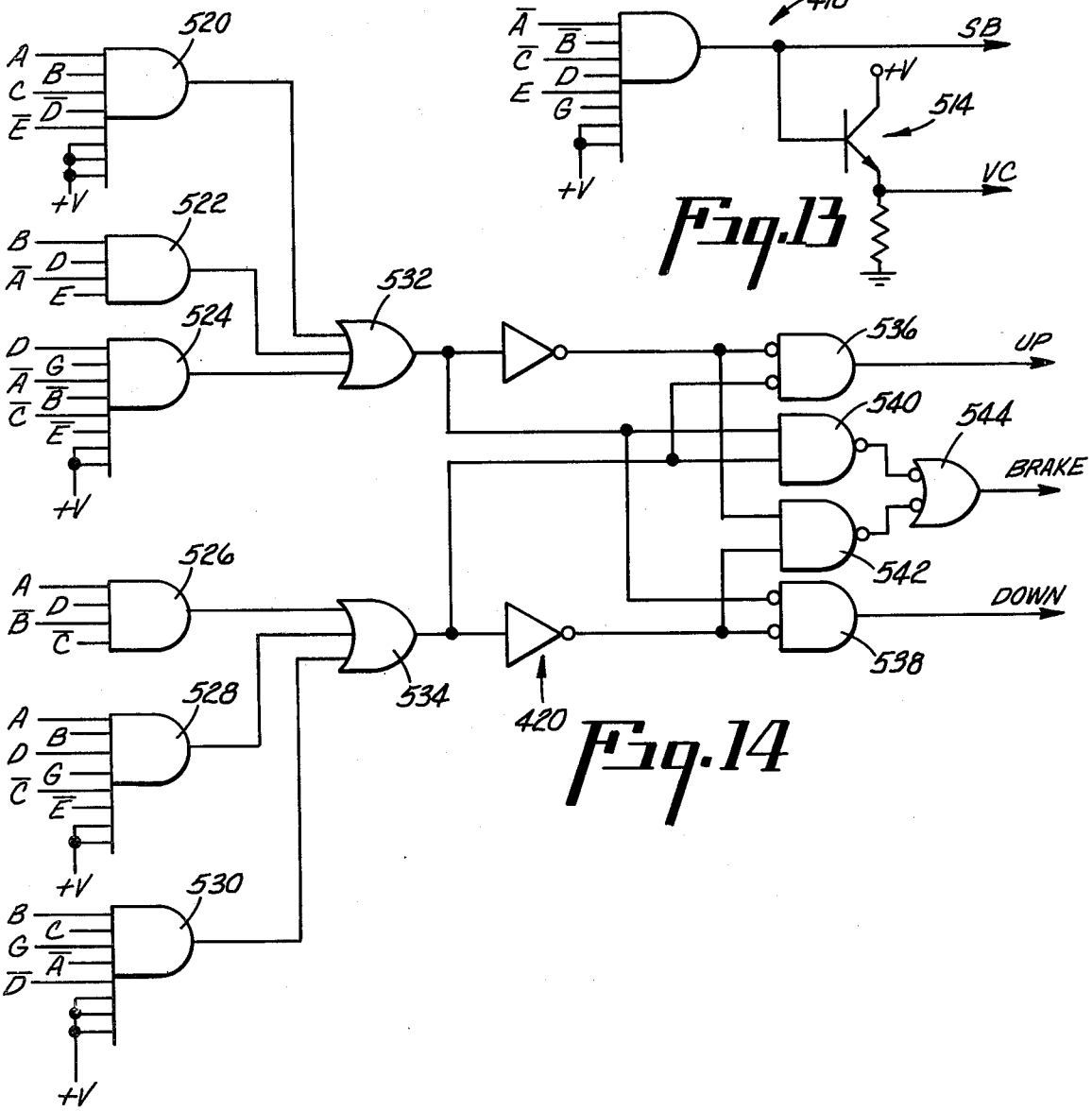
Fig.14

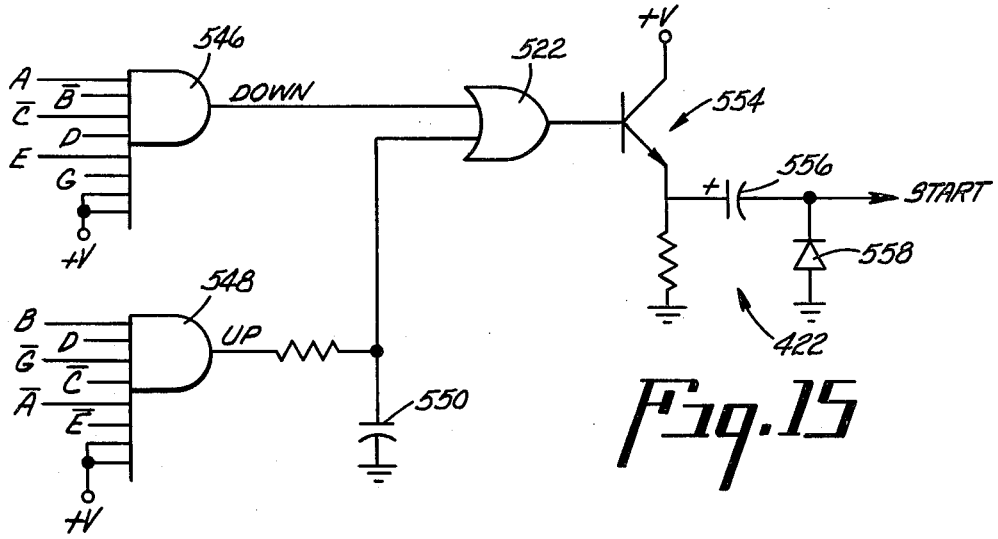

Fig. 15

| | | MODE | CORNER GUIDES | | TRANSPORT RACK | | PAPER TABLE | | RECYCLE TRAY | FEEDER RELEASE | PAPER TABLE | | CORNER GUIDES | STRIPPER BAR |
|---|---|---|---|---|---|---|---|---|---|---|---|---|---|---|
| | | A | DN. B | OUT C | IN D | TOP E | BOT. G | | RT | FR | UP | DN. | CG | SB |
| MACHINE IN CONDITION FOR "RECYCLE" OPERATION | 1 | 0 | 0 | 0 | 1 | 1 | 1 | | 0 | 0 | 0 | 0 | 0 | 1 |
| | | | | | | | | | | | | | | |
| SET CONTROL FOR "STRAIGHT THROUGH" | 2 | 1 | 0 | 0 | 1 | 1 | 1 | | 0 | 1 | 0 | 1 | 1 | 0 |
| | 3 | 1 | 0 | 0 | 1 | 0 | 1 | | 0 | 1 | 0 | 1 | 0 | 0 |
| | 4 | 1 | 1 | 0 | 1 | 0 | 1 | | 0 | 1 | 0 | 1 | 0 | 0 |
| | 5 | 1 | 1 | 0 | 1 | 0 | 0 | | 1 | 1 | 0 | 0 | 0 | 0 |
| | 6 | 1 | 1 | 0 | 0 | 0 | 0 | | 0 | 1 | 0 | 0 | 0 | 0 |
| | 7 | 1 | 1 | 1 | 0 | 0 | 0 | | 0 | 1 | 1 | 0 | 0 | 0 |
| MACHINE IN CONDITION FOR "STRAIGHT THROUGH" OPERATION | 8 | 1 | 1 | 1 | 0 | 0 | 1 | | 0 | 1 | 1 | 0 | 0 | 0 |
| | 9 | 1 | 1 | 1 | 0 | 1 | 1 | | 0 | 0 | 0 | 0 | 0 | 0 |
| | | | | | | | | | | | | | | |
| SET CONTROL FOR "RECYCLE" | 10 | 0 | 1 | 1 | 0 | 1 | 1 | | 0 | 1 | 0 | 1 | 0 | 0 |
| | 11 | 0 | 1 | 1 | 0 | 0 | 1 | | 0 | 1 | 0 | 1 | 0 | 0 |
| | 12 | 0 | 1 | 1 | 0 | 0 | 0 | | 1 | 1 | 0 | 0 | 0 | 0 |
| | 13 | 0 | 1 | 0 | 0 | 0 | 0 | | 0 | 1 | 0 | 0 | 0 | 0 |
| | 14 | 0 | 1 | 0 | 1 | 0 | 0 | | 0 | 1 | 1 | 0 | 1 | 0 |
| MACHINE IN CONDITION FOR "RECYCLE" OPERATION | 15 | 0 | 0 | 0 | 1 | 0 | 1 | | 0 | 1 | 1 | 0 | 0 | 0 |
| | 16 | 0 | 0 | 0 | 1 | 1 | 1 | | 0 | 0 | 0 | 0 | 0 | 1 |

Fig. 16

AUTOMATIC RECIRCULATING DUPLICATOR

BACKGROUND OF THE INVENTION AND PRIOR ART

The present invention relates as indicated to printing apparatus and more particularly to single head duplicators which are adapted to print selectively on one or both sides of paper sheets with minimum operator involvement.

Prior methods of printing on both sides of paper sheets on a simplex duplicator have necessitated that the operator manually remove from the receiver the stack of sheets printed on one side, crank down the paper table, insert the sheets blank side up, change the plate, crank the magazine up and restart the duplicator. When constant two-sided runs are involved on such a simplex duplicator, considerable lost production time accumulates through manual preparation for recycling.

Other prior procedures for printing on both sides of sheets using a single printing head involve first feeding copy sheets from a supply source to a receiver, and then, using the receiver as a supply source, feeding the sheets through an alternate turnover path to the printing nip for a second impression. In apparatus of this type the convolutions and complexity of the second path are normally such as to offer undue problems in sheet handling especially if the process involves the making of impressions with wet ink as in the case of a lithographic duplicator. One exemplary apparatus of this type is shown and described in U.S. Pat. No. 4,080,060.

BRIEF STATEMENT OF THE INVENTION

Briefly, the present invention is in providing a more fully automated duplexing duplicator with a single print head, and in doing so without the refeeding problems encountered in certain prior art devices. It incorporates capabilities of printing on either both sides of the paper sheets with minimum operator involvement, or printing on one side only when desired.

When the operator pre-selects for two-sided printing, the copy paper is fed from a paper table and a special gripper-cam solenoid control is conditioned to turn each sheet through at least 180° for delivery onto an auxiliary paper tray where the sheets are stacked and jogged. When the presettable total number of copies to be produced is satisfied, the paper tray is mechanically shifted to a location wherein the sheets which it carries can be readily fed by the existing feed devices to the printing nip for printing on the reverse side of the sheet.

In the preferred form described in detail herein, the paper table is lowered to a predetermined level and the auxiliary paper tray with the accumulated, inverted and jogged copies printed on but one side is moved horizontally by a transport slide to a position directly over the supply of unprinted paper sheets on the paper table. The paper table then rises and, with the auxiliary paper tray now positioned thereon, is elevated to a position for delivery of the printed sheets from the tray serially into the printing nip in the normal manner using the same feeding equipment as before. During a time when the auxiliary paper supply tray is being moved to the feeding position, the master used to print the first side of the sheets is removed, the blanket cleaned and dried, and a new master manually or automatically inserted for printing on the opposite side of the paper. At this time a gripper-cam control is activated so that printed sheets will be directed to an exterior receiver.

When the auxiliary or recycle paper tray reaches the feed position, paper feed is started. As the last sheet feeds from the auxiliary paper tray, feeding is stopped, the auxiliary tray is lowered onto the waiting transport slide which then moves the tray back into position ready to receive sheets for the next run.

The present invention provides for increased production, decreased initial cost from that of known duplexing equipment, simplified operation, and service of dual purposes, i.e., printing on one side only as well as duplexing in limited floor space, and utilization of a single set of paper feeding and registering equipment for printing both sides of duplex printed sheets from a single printing couple.

BRIEF DESCRIPTION OF THE DRAWINGS

The present invention will be better understood by having reference to the annexed drawings wherein:

FIGS. 11–15 are more detailed schematic diagrams of the combination logic circuits used in the system of FIG. 10; and FIG. 16 is a truth table useful in understanding the operation of the control system of FIGS. 10–15.

DETAILED DESCRIPTION OF THE DRAWINGS

Figure 1:
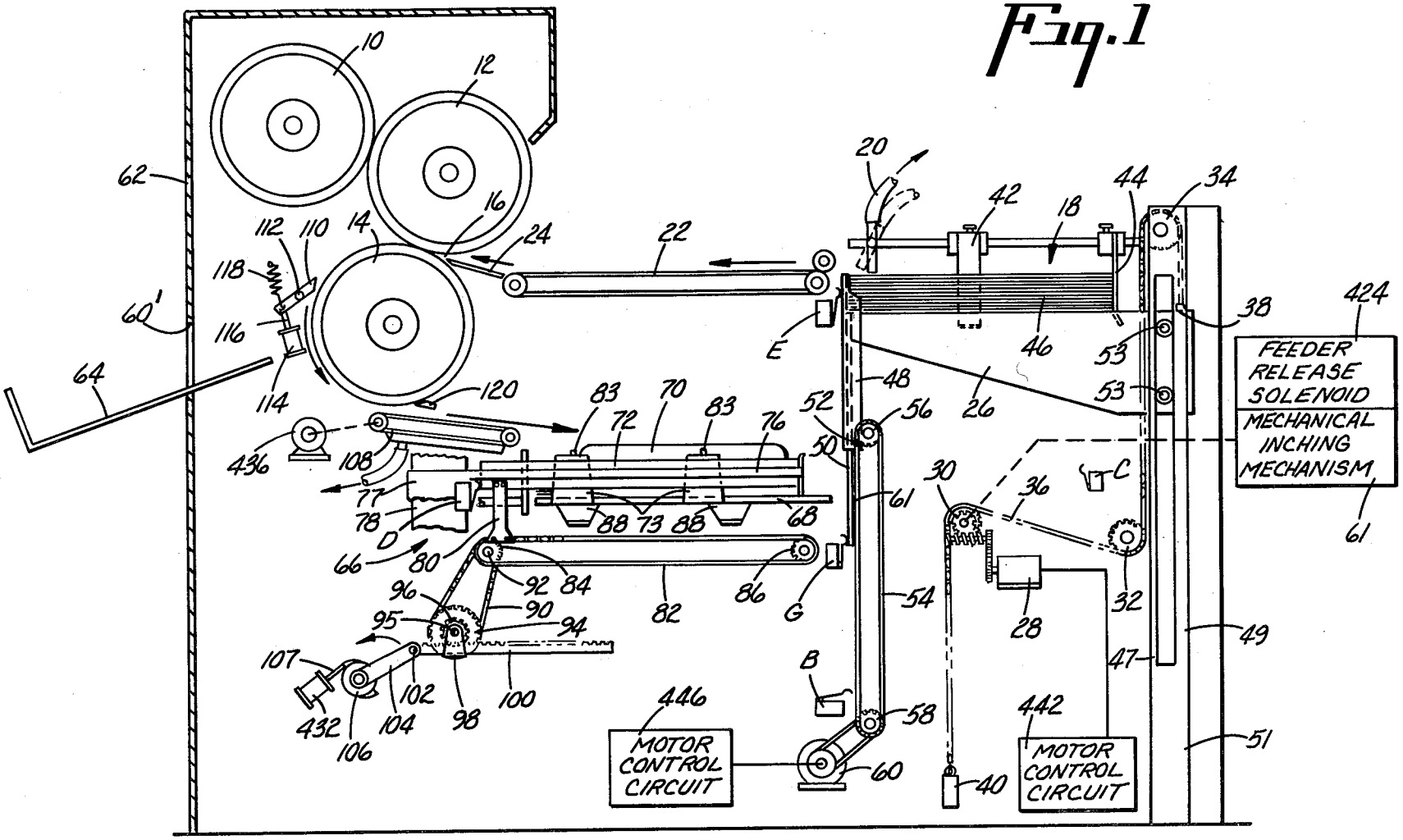
FIG. 1 is a diagrammatic elevation of a duplicating machine in accordance with the present invention and having a single printing nip, and adapted for printing on one or both sides of paper sheets.
Figure 2:
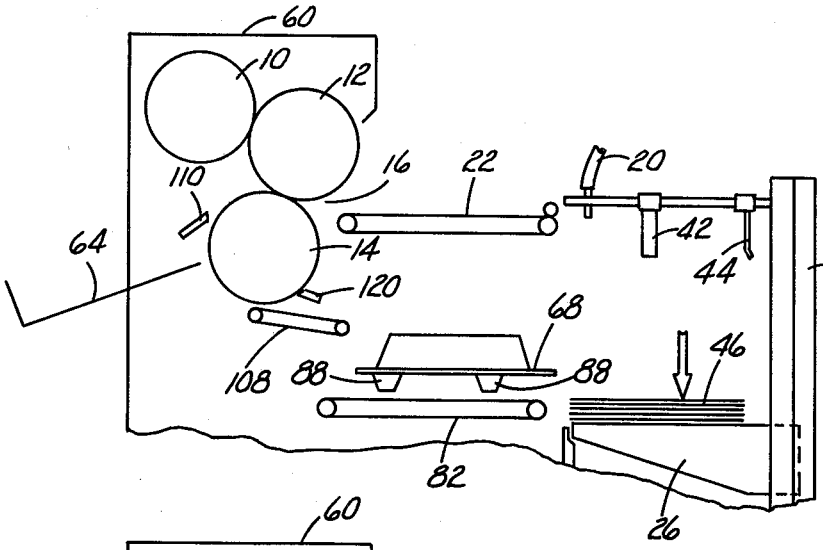
FIG. 2 is a diagrammatic and schematic elevation on a reduced scale, generally similar to FIG. 1, but showing the condition of the apparatus after printing of a run on one side has been completed, and after the main paper table has been lowered for superposition of the auxiliary paper tray thereon.
Figure 3:
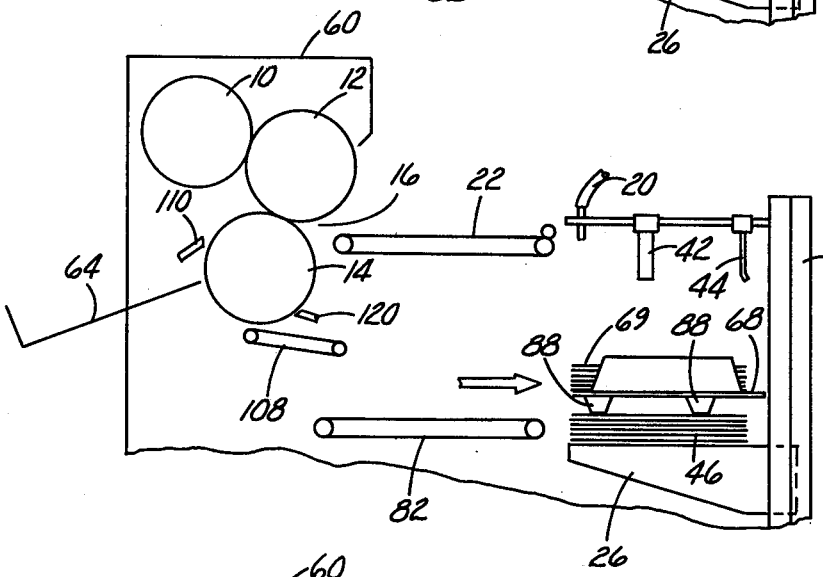
FIG. 3 is a diagrammatic and schematic representation of the apparatus as shown in FIG. 2, but with the auxiliary paper tray disposed above the main paper table prior to elevation.

FIG. 1 shows in somewhat diagrammatic form an automatic recirculating duplicator having a single plate cylinder 10 running in impression transferring relation with a blanket cylinder 12 which in turn runs with an impression cylinder 14. The blanket cylinder and the impression cylinder define therebetween a printing nip 16. The apparatus of the present invention is a sheet fed device. Accordingly, individual sheets of paper are carried in a paper supply mechanism, generally indicated at 18, and are fed by suitable feeding means such as conventional suction feeding means 20. Conventional mechanical indexing means, illustrated diagrammatically at 61, is provided for inching the paper supply mechanism upwardly to maintain the top paper sheet in position to be fed by the feeder 20. The fed sheets are transported by a conveyor 22 up a ramp 24 and into the printing nip 16. As the sheets pass over the conveyor 22 and ramp 24 they are jogged into lateral alignment and controlled in longitudinal registry by conventional equipment (not shown). The paper supply arrangement 18 includes a paper table 26 movable between an elevated position as shown in FIG. 1, and a lowered position such as shown in FIGS. 2 and 3 by means of table elevating motor 28. The motor 28 is connected through suitable drive means to a chain sprocket 30, a turning sprocket 32 and a head sprocket 34 by a chain 36. One end 38 of the chain 36 is secured to the paper table 26 and the free end thereof is conveniently provided with a counterweight 40 to facilitate movement of the table between its elevated position as shown in FIG. 1 and its lowered position as shown in FIGS. 2 and 3.

In order to maintain the paper supply 46 in proper alignment for delivery to the conveyor 22, there are provided lateral alignment bars such as the bar 42 and the end bar 44, adjustably mounted on the machine frame to coact with the paper stack when the paper table 26 is in its upper position. They are preferably arranged to telescope spontaneously when not needed, as when the tray 68, described hereinafter, replaces the paper table at feeding position. To maintain the lead edges of the paper in proper alignment, there are provided independently extendable and retractable corner guides such as the corner guide 48. The corner guides are movable along suitable vertical trackways 50 (FIG. 1) and are connected through chain link pins such as 52 to endless chains 54 each reaved around sprockets such as 56 and 58. The sprockets 58 are on a common shaft driven by means of a motor 60.

To maintain the supply of paper sheets at the proper level for feeding into the machine, conventional paper height sensing means (not shown) attached to the frame are employed. In such apparatus, when the paper level falls slightly below a prescribed height, it actuates the level sensing means to control a conventional mechanical inching or level adjusting means, indicated diagrammatically at 61, to maintain the pile of sheets at proper feeding height. This apparatus steps off every 6–7 sheets and effects indexing of the table 26 upwardly to the proper level. The mechanical paper height sensing means, and the table level adjustment means just described are disconnected by manually withdrawing a drive pawl from a ratchet wheel. In the present construction this mechanism can be disconnected or reconnected by energizing or deenergizing a solenoid acting upon such conventional drive pawl. Whenever the conventional mechanical inching or level adjusting mechanism 61 is in operation, the elevating motor 28 will be deenergized and will merely follow the movement of the chain 36.

When the apparatus is used for printing on a single side only, the printed sheets after passing through the printing nip 16 are stripped from the impression roll 14 by means hereinafter more particularly described, and cascaded through an opening 60' in the equipment shroud 62 and onto an external paper receiver or delivery bin 64.

So that the apparatus may be used for duplex printing, e.g., printing on both sides of the same sheet, an auxiliary tray and transfer system generally indicated at 66 is provided. The horizontally displaceable auxiliary paper tray 68 has four support brackets 73 (see FIG. 5), each provided with a lip 75 which rests upon the upper edge of one or the other of a pair of parallel slides 72, only one being shown in FIG. 1. For precise positioning of the tray on the slides, the latter carry guide pins 83 which mesh with openings 81 in the lips 75. Each slide 72 moves along a stationary track member 76 supported on a pedestal 78. In order to move the auxiliary paper supply tray 68 horizontally, the slide 72 is secured to an endless chain 82 as by a pin, or other connecting device, e.g. the arm designated 80. The chain 82 is reaved about sprockets 84 and 86 spaced apart a distance sufficient to transfer the auxiliary paper tray 68 from the location shown in FIGS. 1 and 2 to a location as shown in FIG. 3 and which will be described in greater detail below.

The auxiliary paper tray 68 is also provided with legs 88 for supporting the auxiliary paper tray 68 on the paper stack 46 as will be described below.

The sprocket 84 is driven by a flexible chain 90 reaved about a driven sprocket carried on the same shaft 92 as the sprocket 84, and a drive sprocket 94 drivingly connected to a shaft 95 carrying a spur gear 96. The spur gear 96 is driven by a rack 100 which is held in meshing engagement with the spur gear by a guide yoke 98 rockable on the shaft 95. One end of the rack 100 is connected by means of a pivot pin 102 to an arm 104 which is directly connected to a half revolution clutch 106 which, in turn, is driven by any continuously rotating shaft on the machine. Thus, when a dog 107 is momentarily withdrawn, as by the action of a solenoid 432, the half revolution clutch 106 will revolve counterclockwise to a first stop position (in contact with the restored dog) whereby the auxiliary paper tray is driven to the right as shown in FIG. 1. When the dog is withdrawn a second time, the clutch 106 will make another half revolution in the same direction to a second stop position, this time driving the rack 100 to the right and thereby effecting a return of the auxiliary paper tray 68 in a leftward direction to the position shown in FIG. 1.

In order to transfer the printed sheets in a print side down condition to the auxiliary paper tray 68, there is provided a vacuum conveyor 108 which coacts to carry sheets from the bottom side of the impression cylinder 14 to the auxiliary paper tray 68. The vacuum is supplied to the conveyor by any suitable fan or pump arrangement (not shown) and the conveyor is powered by a suitable means such as the electric motor 436.

Figure 5:
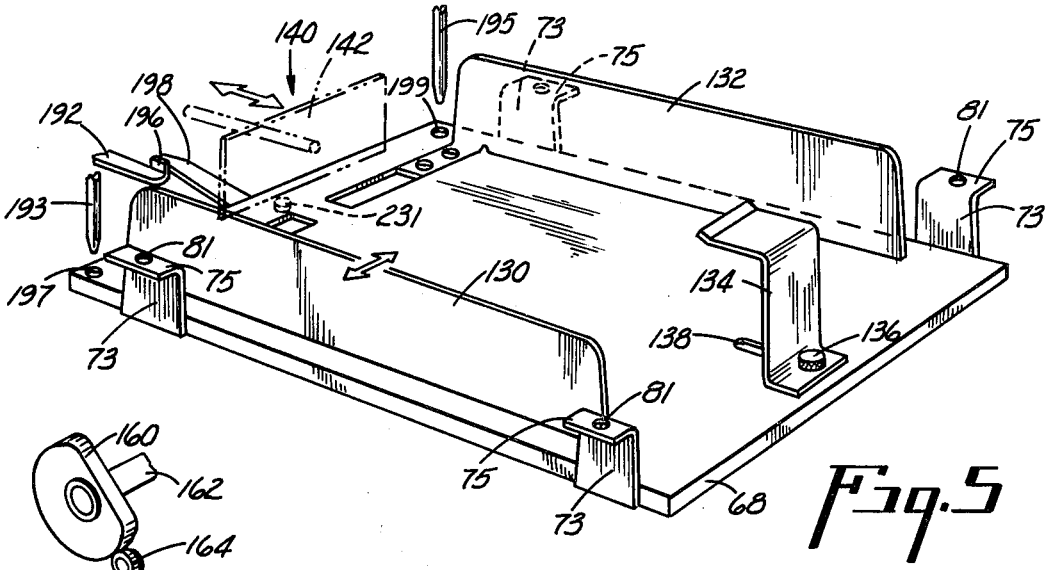
FIG. 5 is a perspective view of the auxiliary paper tray for collecting in inverted condition, sheets which have been printed on one side showing the locating pins which coact therewith when in feeding position and, indicated in broken lines, a portion of the jogging mechanism which coacts therewith when the tray is in sheet receiving position.
Figure 6:
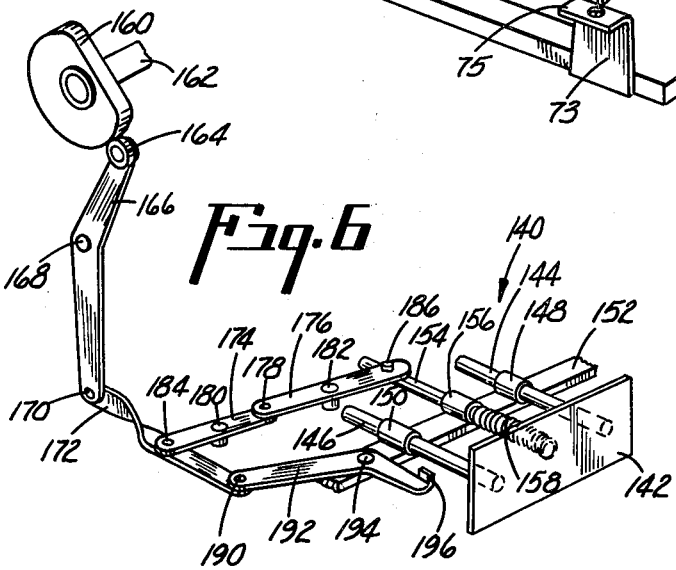
FIG. 6 is a perspective illustration of a jogging mechanism for use with the auxiliary tray shown in FIG. 5.
Figure 7:
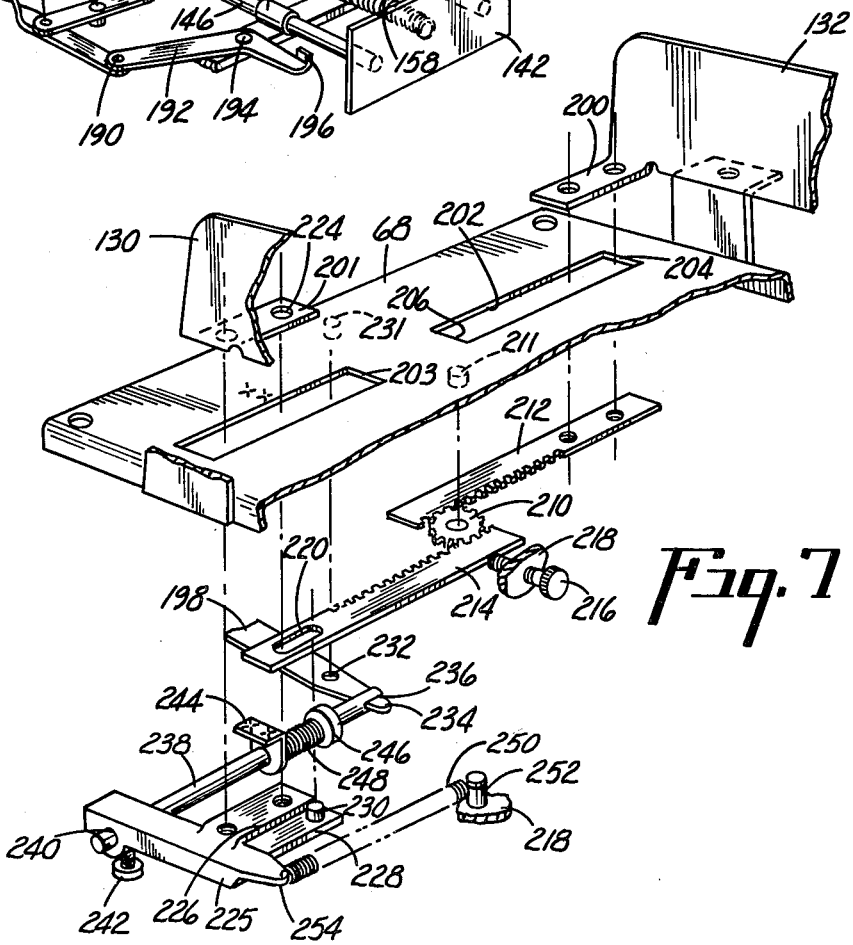
FIG. 7 is an exploded view of a portion of the paper tray of FIG. 5, and showing the side jogging and edge guide system for the paper.

To facilitate stripping of the paper sheet from the impression cylinder when the grippers are released at a predetermined position as hereinafter described, there is provided a stripper bar or element 110 pivotally secured on a frame mounted shaft 112, and actuated by means of a solenoid 114. In the position shown in FIG. 1, the solenoid 114 is energized and the plunger 116 is drawn into the solenoid 114 in opposition to the spring 118, and the stripper 110 is therefore in an inoperative position with respect to paper travelling on the surface of the impression cylinder 14. A fixed stripper 120 is provided for assisting the removal of printed sheets of paper from the bottom side of the impression cylinder 14 for transfer to the conveyor 108 and thence to the auxiliary paper tray 68. The details of the paper jogging means for the auxiliary paper tray 68 are shown in FIGS. 5, 6 and 7 described in greater detail below.

The paper table 26 is translatable vertically, and its motion path is defined by pairs of rails such as 47, 49 in frame members 51, one pair of each side of the machine. Pairs of spaced guide rollers 53, mounted on the table, coact with the said rails to assure proper tracking of the table 26.

A number of control switches are provided and shown in FIG. 1, and these will be discussed below in connection with the control circuitry.

Figure 4:
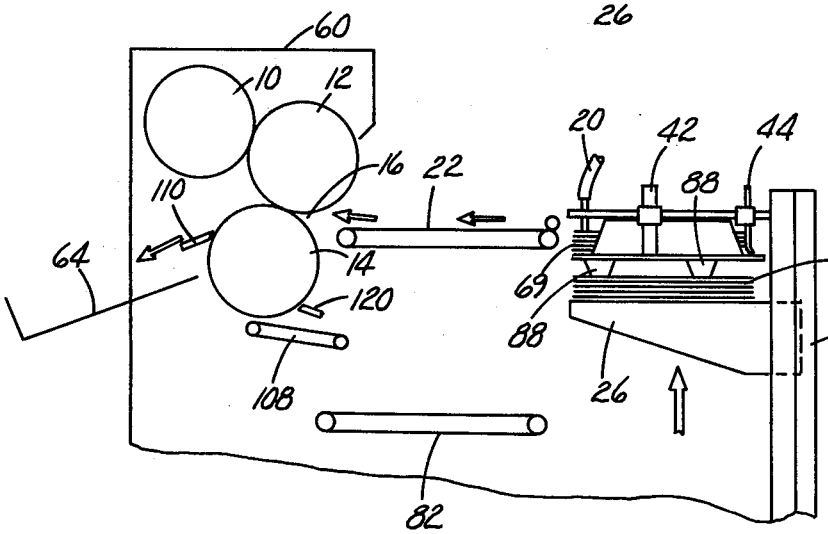
FIG. 4 is a diagrammatic and schematic representation of the apparatus as shown in FIGS. 2 and 3, but with the superposed auxiliary paper tray elevated to a position for feeding into the printing nip and in condition for the sheets to be discharged to an external receiver.

FIGS. 2, 3 and 4 as well as FIG. 1, show the several stages of operation of the devices in accordance with the present invention. In FIG. 1, the paper table 26 provided with a stack of unprinted paper sheets 46 is in position for delivery of successive paper sheets for a printing run to the conveyor 22 and through the printing nip 16. If the solenoid 114 were deenergized, and the sheet ejection cam 260 described below were in an appropriate position, the machine would then be in condition for operation as a simple duplicating machine for printing upon one side of the sheet only. In such a printing condition, referred to as "simplexing," the sheets travel from the supply 46 over the conveyor 22 through the nip 16 and are picked off by the stripper 110 and cascaded into the delivery bin 64 where they can be picked up by the operator.

If the machine is to be operated as a duplex duplicating machine, the mechanism is sequentially settable in two modes. In the first or "recycling" mode, the paper table 26 with the supply 46 thereon is used in the same manner as above described for an operation for printing one side only, except that in this mode the stripper 110 is moved to an inoperative position, the ejector cam is moved to its alternate position as below described, and the stripper 120 is now active to remove the sheets from the surface of the impression cylinder after they have turned through at least 180° for deposit onto the conveyor 108 and cascading into the auxiliary paper supply tray 68, printed side down. The mechanism is then placed in a second or "straight through" mode which is accomplished in the following manner. First the paper table 26 is lowered as shown in FIG. 2 to its bottom position, and the corner guides 48 (FIG. 1) are also lowered to their fully retracted position by means of the chains 54. The conveyor chain 82 is then actuated effecting a horizontal transfer of the auxiliary paper supply tray 68, now carrying a supply of sheets 69 printed on but one side and with the printed side down, to the position shown in FIG. 3 in which its supporting feet 88 are slightly above the topmost sheet of the pile 46. Next the paper table 26 with the auxiliary paper tray 68 superposed thereon is elevated to a feed position as determined by a sensing switch E coacting with the sheets on the paper tray, and the suction feed 20 is energized to deliver sheets successively across the conveyor 22 to the printing nip 16 to receive an impression from a second plate. At this time the stripper 110 and the gripper cam control described below are actuated to the condition for delivery of the sheets, printed on both sides, to the external bin 64. When it is desired to restore the equipment to the first or recycle mode in order to start another duplexing operation, the paper table 26 is again lowered so that the auxiliary paper tray 68 will rest upon the slides 72 to be returned thereby to its original position as shown in FIG. 1. Thereafter, the paper table 26 with the blank sheets thereon is returned to its initial elevated position, and the corner guides 48 elevated to their original position to initiate printing of a succeeding leaf or page from a new plate.

Referring now more particularly to FIGS. 5, 6 and 7, the sheets which are stripped from the impression cylinder 14 must be returned to an aligned condition for proper feeding of the sheets for printing on the reverse side. To this end, the auxiliary paper tray 68 as shown in FIG. 5 is provided with side guides 130 and 132, and back guide 134. The back guide 134 is adjustable to various sheet lengths by means of a screw 136 and a nut (not shown) coacting with a slot 138 in the tray 68. In order to provide jogging of the sheets collected on the tray 68, the tray side guides 130 and 132 are not only adjustable to a predetermined width, but also the guide 130 is movable back and forth along a transverse path by any suitable mechanism, as for example, that shown in FIG. 7. Not only must the sides of the sheets be jogged to an aligned condition, but so also must the ends of the sheets. Accordingly, end jogging means generally indicated at 140 and movable back and forth along a longitudinal axis of the paper are provided, these means being shown in greater detail in FIG. 6.

According to FIG. 6, there is provided a jogging plate 142 secured to spaced guide bars 144 and 146 slidably mounted in sleeves 148 and 150, respectively, secured to a fixed support 152 on the machine frame. A slide 154 is also secured to the jogging plate 142 and slidably passes through a sleeve 156 also secured to the support 152. A spring 158 coacts between the jogging plate 142 and the fixed sleeve 156 to urge the jogging plate to a fully extended position relative to the fixed support 152.

In order to actuate the jogging plate 142, there is conveniently provided a cam 160 mounted on a shaft 162. The shaft 162 may be directly driven from the impression cylinder drive gear on the impression cylinder 14 or through any suitable gear train or chain drive means (not shown). The cam 160 coacts with a cam follower 164 mounted at one end of crank 166 pivotally secured to a fixed frame member through a pivot 168. The other end of the crank 166 is pivotally secured by a pin 170 to one end of a link 172. The oscillatory motion imparted to the link 172 serves to drive not only the end jogging plate 142, but also the side jogging mechanism of FIG. 7 as will be described below. To drive the end jogging plate 142, a pair of levers 174 and 176 are pivotally connected together by a pin 178. The lever 174 is provided with a pivot 180 mounted on a rigid frame member. In like manner, the lever 176 is provided with a pivot 182 also mounted on a frame member. One end of this articulated lever assembly is secured by means of a pivot pin 184 to the link 172. The opposite end of the lever assembly is pivotally secured by means of a pin 186 to the bar 154. Thus, as the link 172 is moved back and forth by the action of the cam on the cam follower 164, the lever 176 rocks about its pivot 182, causing the slide 154 and the attached jogging plate 142 to move back and forth along the path as determined by the sleeve 156.

The other end of the link 172 is pivotally connected through a pin 190 to a bell crank 192 mounted for rotation on a pivot 194 conveniently located on a fixed support such as the member 152. Movement of the bell crank by means of the link 172 causes a finger 196 on the free end of the crank to oscillate back and forth. A portion of the bell crank 192 and the side jogging finger 196 are shown in FIG. 5. The side jogging finger 196 coacts with a side jogging lever 198 pivotally mounted on the tray 68 as shown in FIGS. 5 and 7.

FIG. 7 shows an exploded view of the jogging and edge guide system which is mounted on the paper tray 68 and located below the paper supporting surface thereof. The side guide plates 130 and 132 are slidably carried by the surface of the auxiliary tray 68, but not secured thereto. The side guide plate 132, for example, is provided with an integral foot member 200 bent out of the plane of the side guide 132 at right angles thereto, and dimensioned to slidably fit in an elongated slot 202 which extends through the bottom of the paper tray 68. The length of the slot 202 exceeds the length of the foot portion 200 so that the side plate 132 can be moved between a maximum width position adjacent the outer end 204 of the slot 202 to accommodate the largest size paper, and an inner end 206 of the slot 202 to accommodate the narrowest size of the paper.

In like manner, the side plate 130 is also provided with a foot portion 201 which in turn is dimensioned for transverse sliding movement in a slot 203 similarly cut through the table 68.

The equal and opposite movement of the side plates 130 and 132 for adjusting to accommodate paper width is effective through a double rack and pinion assembly composed of a pinion 210 located in a fixed position on the bottom of the paper tray 68 by a pivot 211 shown in dotted lines. The pinion 210 coacts with a first slidable rack 212 which is fastened directly to the foot member 200 such as by screws (not shown). A second slidable rack member 214 is provided for transmitting an equal and opposite movement to the side guide member 130. The rack and pinion assembly is provided for adjustment of the distance between the side plates 130 and 132 to accommodate various sizes of paper sheets as well as allowing jogging movement of the side plate 130 toward and away from the side plate 132, as will be presently described. Once the proper size has been determined and the location of the side plates 130 and 132 determined, this adjustment can be set by means of a set screw 216 coacting between the rack bar 214 and a fixed member 218 which preferably forms part of a housing attached to the bottom of the tray 68 and enclosing the racks and associated mechanism. The rack bar 214 is provided with a short slot 220, and is attached only indirectly by a lost motion connection to the foot portion 201 of the side guide member 130, as will presently appear.

Both jogging movement of the side guide 130 and sheet width adjustment are provided by the following mechanism. The foot portion 201 is secured to a slidable bracket 225 by machine screws (not shown). The slidable bracket 225 has a raised portion 226 which is dimensioned for sliding coaction within the slot 203 and is offset relative to the rack bar 214 to compensate for the diameter of the pinion 210 and the width of the rack bar 214. In the laterally extending plate portion 228 of the bracket 225, which includes the raised portion 226, there is provided an upstanding pin or boss 230 fixedly secured thereto. The pin 230 is accepted in the slot 220 in the rack bar 214, and when the parts are assembled, holds the rack bar 214 in proper relative position between the bottom of the tray 68 and the slidable bracket 225. A pin 231 (shown in phantom) is secured to the underside of the paper tray 68 and is adapted, by entering a hole 232 in the side jogging lever 198, to act as a pivot therefor to mount the same upon the under surface of the paper tray 68 (see also FIG. 5). Thus, the lever 198 is adapted to pivot about the pin 231 in response to movement of the side jogging finger 196 at the end of the bell crank 192. A distal extremity 234 of the side jogging member 198 is adapted to fit into a slot 236 in the end of a jogging bar 238. The jogging bar 238 adjustably extends through a bore 240 in the bracket 225. When the adjusted position has been determined, the bar 238 and the member 225 are locked together by means of a set screw 242 so as to normally move as a unit.

The bar 238 is slidably supported adjacent the bottom of the auxiliary paper tray 68 by means of a guide bracket 244 fastened by means of welds to the bottom of the auxiliary paper tray 68. A collar 246 is provided on the bar 238, and a compression spring 248 coacting between the bracket 244 and the collar 246 tends to urge the bar 238 in a manner to pivot the side jogging member 198 in a counterclockwise manner as shown in FIG. 7 about the pin 231 on the underside of the paper tray 68. In other words, the spring 248 tends to urge the bar 238 and the bracket 225, plus the attached side quide 130, towards the right in FIG. 7.

A tension spring 250 coacts between a fixed pin 252 on the housing 218, and the outer end 254 of the bracket 225, and thus cooperates with spring 248 to urge the bracket and the attached side guide 130 towards the opposite side member 132, and thus to bring the pin 230 into engagement with the inner end of the slot 220 in the rack bar 214.

Thus the tray sides 130 and 132 can be adjusted to a spacing which will properly accommodate the size sheet being used, and the jogging mechanism actuated by the cam 160 as shown in FIG. 6 can operate independently, because of the outward extent of the slot 220, to oscillate the side guide 130 and thus assure that the sheets as they are received from the impression roll 14 are properly aligned in the auxiliary tray 68 before being printed on the reverse side.

Referring back again to FIG. 5, it will be appreciated that the paper tray 68 must be in proper registry with the conveyor 22 for proper delivery of the recycled sheets 69 (FIG. 4) to the conveyor 22. To this end, positioning pins 193 and 195 are secured to and depend from the frame of the apparatus as such a location as to coact with guide holes 197 and 199 at the corners of the auxiliary paper tray 68 and thereby guide the tray into precise feeding position as the tray rises.

Figure 8:
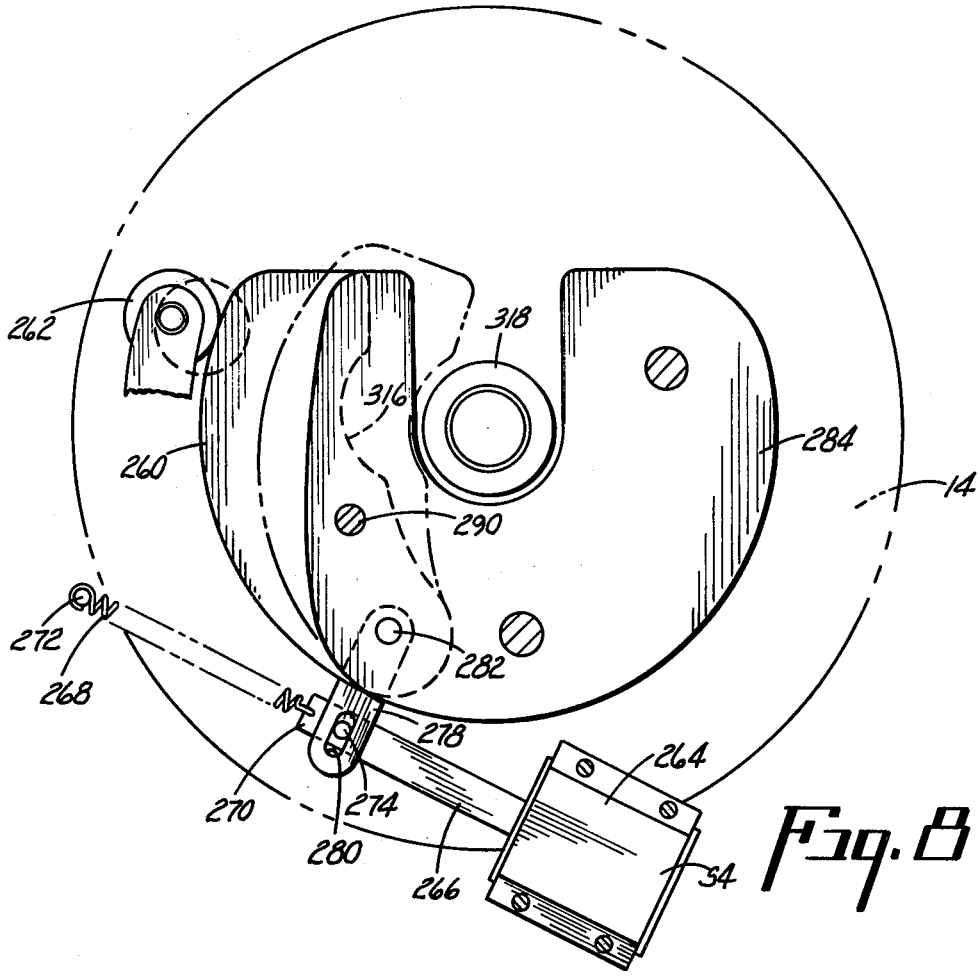
FIG. 8 is a detail view of a cam mechanism and control means therefor for the impression cylinder, which mechanism controls the action of the sheet gripper in either of two printing modes.

FIG. 8 shows an apparatus for actuating conventional paper grippers in a gap in the surface of the impression cylinder 14. In the straight through mode for duplexing (or in simplexing) the printed sheets are stripped by stripper 110 from the surface of the impression cylinder 14 after having been in contact therewith for just a small angle of rotation, and the sheet is cascaded into the external receiver 64. In the recycling mode for duplexing, the grippers retain the sheet on the surface of the impression roll 14 for angular rotation through at least 180° to invert the sheet for cascading into the auxiliary paper tray 68. As shown in solid lines in FIG. 8, a cam leaf 260, forming a part of a fixedly mounted adjustable cam 284 is shown in the position it would occupy for the straight through mode where the printed sheets are cascaded into the receiver 64. In dotted lines, the cam leaf 260 is shown in a position such that the cam follower causes the gripper to hold the paper in a gripped position while the cylinder rotates through somewhat more than 180° of rotation. The cam follower is identified by the numeral 262. It is pivotally mounted in conventional manner on the cylinder 14 to orbit the cam 284, and its action upon the grippers is conventional.

In order to effect change from one mode of operation to the other, there is provided a solenoid 264 having a plunger 266 extending therefrom and biased to an extended position by means of a spring 268 coacting between the distal end 270 of the plunger 266 and a fixed pin 272. Adjacent the distal extremity 270 of the extendable plunger 266, there is provided a pin 274. The cam leaf 260 has secured thereto a lever arm 278 having a slot 280 in one end thereof positioned to receive the pin 274 therein. The leaf 260 and its integrally associated lever arm pivot about a pivot pin 282 in response to movement of the plunger 266. The movement of the cam leaf 260 changes the contour of the fixed U-shaped cam 284 in the critical area, and thus controls the action of the paper grippers in shifting from one mode to the other. As shown in FIG. 8, the cam leaf 260, as it appears in solid lines, is in the straight through mode in which the printed sheets leave the surface of the impression roll 14 and are cascaded into external paper bin 64. In this condition, the spring 268 has been extended, the solenoid 264 having been momentarily energized and the plunger has correspondingly been retracted into the solenoid 264. The parts are then latched in this position in a manner which will presently appear. In the recycle mode, the solenoid 264, being deenergized, the leaf is unlatched and the spring 268 returns the plunger 266 to its fully extended position and the cam leaf 260 to the position shown in dotted lines in FIG. 8 whereupon the grippers (not shown) remain closed and hold the sheets to the surface of the impression cylinder 14 for about 180° of rotation and release at a point where the fixed stripper 120 (FIG. 1) aids in the removal of the sheets from the surface of the impression cylinder 14 for cascading into the auxiliary paper tray 68.

Figure 9:
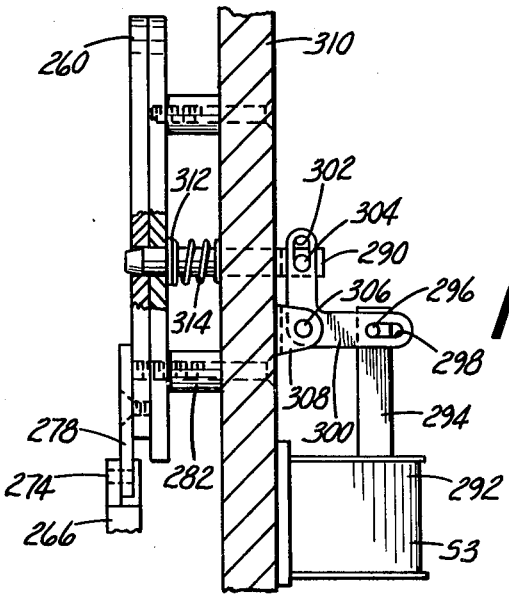
FIG. 9 is a fragmentary cross sectional view of control means for holding and releasing the cam shown in FIG. 8.

FIG. 9 shows in greater detail a latching mechanism comprising a locking pin 290 for locking the cam leaf 260 into the straight through mode position shown in solid lines shown in FIG. 8.

Actuating of the pin 290 is again by means of a solenoid 292 having a plunger 294 movable within the solenoid in response to electrical energization and deenergization thereof. The distal extremity of the plunger 294 is provided with a pin 296 which coacts with a slot 198 in a bell crank 300. The opposite end of the bell crank 300 is also provided with a slot 302 coacting with a pin 304 carried by the locking pin 290. The bell crank 300 pivots about a fixed fulcrum pin 306 carried by a bracket 308 mounted on a side plate 310 of the duplicator.

The locking pin 290 is provided with a collar 312 secured thereto. A biasing spring 314 acts against the collar 312 to urge the pin 290 into a locking position as shown in FIG. 9. The force of the spring 314 is overcome by the solenoid 292 when the plunger 294 is retracted into the solenoid. When the pin 290 is withdrawn from locking engagement with the cam leaf 260, the spring 268 is able to return the cam leaf 260 to the position shown in dotted lines in FIG. 8. When the cam leaf is in its innermost position it is, of course, clear of the path of the orbiting follower 262 in its radially innermost position as shown in dotted lines in FIG. 8.

CONTROL SYSTEM

Suitable control means for the foregoing apparatus is described below. This control means provides for automatically controlling various elements of the duplicator in a duplexing condition of operation so as to permit ready conversion between a recycle mode and a straight-through mode. In addition, the control circuit will allow selection of either a simplex or duplex condition of operation. The elements which are controlled by the automatic control circuit include the corner guide motor 60, the table elevating motor 28, the stripper bar solenoid 114, for the stripper 110, the vacuum conveyor motor 436, the recycle tray transport solenoid 432, the feeder release solenoid 424, and the gripper cam leaf lock and set solenoids 292 and 264. Reference will be had to FIGS. 1, 8 and 9 for location of the controlled elements and the sensing switches, in addition to FIGS. 10 to 16 which schematically illustrate the control circuits themselves.

Figure 10:
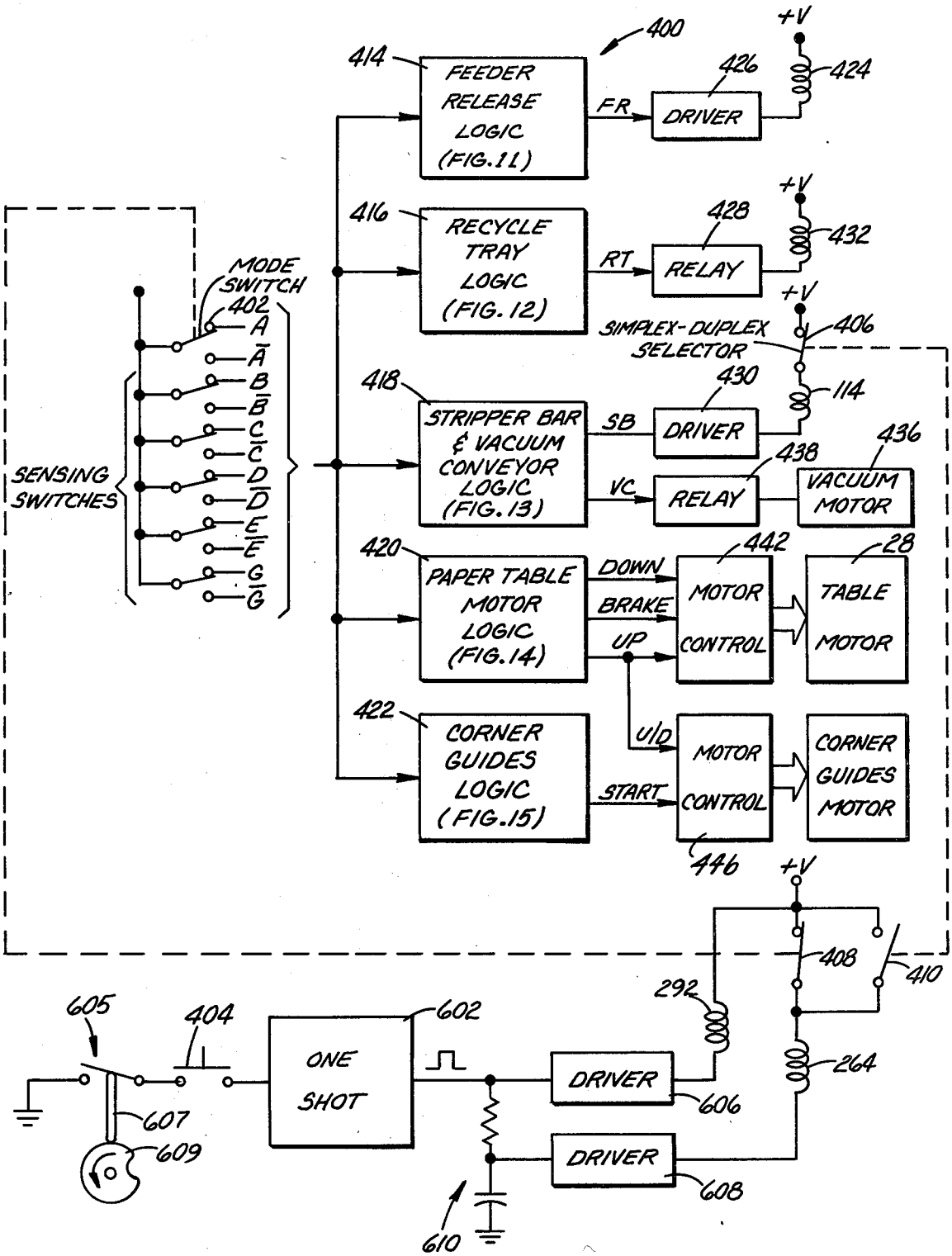
FIG. 10 is a block diagram for a control system useful with a device shown in FIG. 1.

There is illustrated in FIG. 10 a block diagram of the control circuitry. This control circuitry responds to three manually operable switches and five microswitches located within the body of the duplicator. The manually operable switches include a mode selector switch A, a gripper-set push button switch 404, and a simplex/duplex selection switch 406. For convenience of operation, these switches will preferably be located on a readily accessible control panel together with manually actuable controls for initiating and terminating operation of the paper feed mechanism 20.

The sensing microswitches which are included within and operated by the duplicator itself include a corner guide switch B, two auxiliary tray transport rack switches C and D, and two paper table switches E and G. Switches B through G provide signals to the control circuitry which indicate whether various elements within the duplicator are or are not at specified positions. Each of switches B to G is of an SPDT (single pole/double throw) type and includes a contact arm which is connected to a positive voltage supply. Each switch has two possible positions; a normal, untripped position wherein the contact against which the arm nests (and the associated signal) are both designated by the switch letter modified by a bar (as $\overline{B}$), and a tripped position 402 wherein the contact against which the arm nests (and the associated signal) are identified by the same letter as used to identify the switch (e.g. B).

These switches will be located at the positions indicated in FIG. 1. Corner guides switch B will be located at the lower extremity of travel of corner guides 48 and will be positioned to be tripped thereby upon the arrival of corner guides 48 at this position. Similarly, transport rack switches C and D will be located respectively at the outer and inner extremities of horizontal travel of the slide 72 which carries the auxiliary paper supply tray 68, and will be aligned to be tripped by the slide. Finally, paper table microswitches E and G are located adjacent tongue 50 which rigidly depends from the paper table and moves with the paper table. The tongue is so arranged as to be flush with the front edge of a stack of paper on the paper table (or on the tray 68 when carried by the table). Switch E is placed at a position just below the upper limit of movement of the top of a paper stack on the table or tray, and switch G is located at a position corresponding to the top of paper stack on the table when in lower extremity of vertical travel. Because of the relatively large vertical dimension of tongue 26, both switches will be tripped when paper table 50 is in the full up position, while neither will be tripped when the track is in the full down position. It should be noted that the switches E and G are designed to sense the top of the forward edge (leftmost in FIG. 1) of the paper stack, switch E when tripped sensing the arrival of a paper stack, whether on the paper table or the tray 68, and switch G moving to untripped condition to sense escape of the top of the paper stack on the paper table during downward travel.

Referring to manually operated mode switch A, this also is of the SPDT type, and is so connected that when the switch arm is on the A contact it provides a condition for setting the mechanism in a straight through mode (i.e. for feeding paper from the auxiliary paper tray), and when the switch arm is on the $\overline{A}$ contact it provides a condition for setting the mechanism in a recycle mode (i.e. for feeding paper from the paper table in the normal manner).

It will be noted that, with respect to any of the switches A to G above described, they may be considered as developing an actual logic "1" signal in either position, which signal is applied to the condition associated with the contact on which the switch arm rests. However, for the purposes of the truth table hereinafter described, the switch conditions are, for convenience, identified as "1" when the switch arm is on the unbarred contact and "0" when the switch arm is on the barred contact.

The switch output contacts will preferably each be connected to ground through a corresponding suitable resistor (not shown) so that the contacts are never left in a "floating" condition. Each contact is connected by means of a separate bus connection to each of five combinational logic circuits 414 through 422. These combinational logic circuits include circuits for determining when a certain combination of conditions (as indicated by the switches) exists within the duplicator and for operating a particular element of the duplicator when these conditions exist. These combinational logic circuits are shown in greater detail in FIGS. 11 through 15.

The type of outputs provided by the various combinational logic circuits is, of course, dependent upon the nature of the element which is to be controlled thereby. Feeder release logic 414, for example, controls a mechanism which disengages the indexing mechanism mentioned earlier from the paper table, so that the position of the paper table may be controlled by the paper table motor. The feeder release mechanism is operated by a solenoid 424 which must be continuously energized for the duration of the time in which the paper table is to be disengaged from the indexing mechanism. A driver circuit 426 interfaces the feeder release output signal FR provided by feeder release logic 414 with the feeder release solenoid 424. Driver 426 (and also driver 430) is provided for amplifying the control signal provided by the combinational logic circuit to the level necessary to directly control the operation of the solenoid.

Recyle tray logic 416 controls the transport of the auxiliary paper tray between IN and OUT positions. A recyle solenoid 432 serves to operate a clutch which is associated with the recyle tray transport mechanism. If the solenoid 432 were continuously actuated, auxiliary paper tray 68 would continuously cycle between IN and OUT positions. Recycle tray logic 416, however, pulses the recycle clutch solenoid 432 by means of a relay 428 so that at each operation the tray moves from one end of its travel to the other and then stops.

The stripper bar and vacuum conveyor logic 418 jointly controls the operation of the stripper bar solenoid 114 and the vacuum conveyor motor 436. As mentioned previously, a driver 430 interfaces the stripper bar actuation signal SB provided by combinational logic circuit 418 with the stripper bar solenoid 114. The vacuum conveyor motor 436 is supplied with power via a relay circuit 438 which is operated by the vacuum conveyor signal VC supplied by combinational logic circuit 418.

Paper table motor logic 420 operates the paper table motor 28 by means of a motor control circuit 442. Motor control circuit 442 may be of conventional design and includes three input control signals. These signals, which are generated by paper table motor logic 420, include UP and DOWN actuator control signals which cause the motor to move in an upward and downward direction of rotation, and a BRAKE signal which is active whenever both the UP and DOWN control lines are inactive.

Corner guides logic 422 also serves to control a motor, in this case corner guides motor 60. A motor control circuit 446 is provided, different in form than motor control 442, which responds to a direction command (U/D) derived from the UP control line supplied by paper table motor logic 420 and a START signal supplied by corner guide logic circuit 422. When a START pulse is received from the corner guide logic circuit 422, motor control 446 will cause the corner guide motor 60 to be energized in a direction determined by the level of the U/D control line. Although the start command supplied by corner guide logic 422 comprises only a single pulse, motor control 446 will cause corner guides motor 60 to continue to operate until either the upper or lower movement limits are reached thereby. Motor control 446 comprises two relays (not shown): the first relay controls the supply of power to a second relay (actuated by the U/D command) which controls the direction in which the power is applied to the field windings of motor 60. The first relay is a self-latching relay which is actuated by the START command signal, and is released by either an upper limit microswitch or a lower limit microswitch (neither of which is shown) being tripped by the corner guides. The corner guides motor 60 (M2) will therefore serve to move the corner guides from either a full up to a full down position, or vice versa, upon the supply of a START command to motor control circuit 446 by corner guides logic 422.

The order in which these various elements are controlled by the combinational logic circuits may be more readily understood through reference to the truth table of FIG. 16. Each of the fifteen states listed in this truth table identifies a set of conditions that will exist within the duplicator at some time during its operation. The left six columns list input signals derived from switches A through G; the right six columns list output signals derived from the combinational logic circuits. In this figure, a logic "0" indicates the absence of a condition, whereas a logic "1" indicates the presence of a condition (i.e. indicates that the corresponding switch is in the tripped position). Thus, for example, when the corner guides are in some position other than a full down position, signal B will be at a logic "0" level. When however the corner guides are in a full down position, signal B will be at a logic "1" level.

DUPLEXING OPERATION

In discussing the condition of the circuits in relation to the truth table, the assumption is intially made that switch 406 (together with its ganged switch 408) is placed in duplexing position as shown in FIG. 10, since this is the type of operation to which the modes of the truth table basically apply.

State 1 represents the status of the duplicator when being operated in the recycle mode. In this mode, the mode control switch A will be in a position in which its arm rests on the A contact, i.e., corresponding to a "0" condition. Since the corner guides will be in the upper position, input B will be 0. The transport rack will be located at the "IN" position, so that input C will be 0 and D will be 1. The paper table will also be in the upper position, so that both the top and bottom sensing switches E and G will be tripped and will thus provide logic "1" signals to the combinational logic circuits. The outputs of the combinational logic circuits will all be zeros except for stripper bar output signal SB which will be at a logic "1" level. Thus, since the simplex/duplex selection switch 406 is in a closed position, the stripper bar solenoid 114 will be actuated and the stripper bar 110 will be moved out of sheet stripping relation with impression cylinder 14. The operator then turns on the suction paper feed 20 and starts the printing operation. As the paper is fed, it will be carried through at least 180° of rotation about the cylinder 14 and will be stripped by stripper 120 and deposited in the auxiliary paper tray 68.

When the desired number of sheets have been run through this recycle mode to be printed on the first side, the operator turns off the suction feed and triggers the combinational logic circuit to automatically transfer the duplicator to the "straight-through" mode (state 9). To accomplish this, the operator must merely change the position of the arm of the mode control switch A to contact A, thereby causing its signal to shift from an input condition 0 to a condition 1. Immediately thereafter, the manual switch 404 for controlling the impression cylinder grippers is also actuated and will be hereinafter explained. The duplicator will thus enter state 2 of FIG. 16. Upon the transfer of the mode switch from a 0 to a 1 position, the outputs of several of the combinational logic circuits will also change. The stripper bar logic signal SB will shift to a logic 0 so that stripper bar solenoid 114 will be deactuated, thus placing stripper 110 in operation. Also, the feeder release signal FR will shift to a logic 1 condition, as will the paper table down command DN and the corner guides start command ST. This will cause the feeder release solenoid to release the paper table from the mechanical inching mechansim so that it may be moved by the paper table motor 28. The down command DN supplied by paper table motor logic circuit 420 will therefore cause the paper table to be moved downward. Since corner guides logic circuit 422 is providing a start signal ST to motor control 446, and since the UP signal is at a logic 0 level, the motor control circuit 446 will cause the corner guides motor 60 to begin moving the corner guides downward. States 3 and 4 are intermediate states which will occur during the movement of the corner guides and paper table to the retracted position.

Upon the paper table and corner guides reaching their fully lowered position (B=1; E,G=0), state 5 will be entered. The occurrence of this state will cause the actuation of the recycle tray output pulse signal RT which will cause energization of the recycle clutch by means of solenoid 432. The auxiliary paper tray will thus be transported from the IN position shown in FIG. 2 to the OUT position above paper tray 26 as shown in FIG. 3. State 6 is an intermediate state in which the auxiliary paper tray is neither fully in nor fully out. When the auxiliary paper tray 68 has reached its final destination directly above the paper table, input C will go to a "1" condition, thus placing the duplicator in state 7. In this state, the UP output of paper table motor logic circuit 420 will change from a logic "0" to a logic "1" level, thus causing the paper table to once again move to a raised position. State 8 is an intermediate state during which the paper table is in motion.

State 9 is the concluding state, in which the paper table has carried the auxiliary paper tray to a fully up position as shown in FIG. 4 so that the duplicator is ready to be run in a straight-through mode. In state 9 it will be seen that the feeder release logic signal FR has once again changed to a logic "0" level so that the mechanical inching mechanism is once again connected to the paper table. Also, the stripper bar output signal SB is at a logic "0" level so that the stripper bar solenoid 114 is not actuated. Consequently, the stripper bar will rest against the impression cylinder and will serve to remove the paper therefrom and direct it to the external paper holding bin 64.

The operator then starts the suction paper feed 20 which feeds sheets from the stack in the tray 68 to be printed on the second side.

When it is desired to once again change the duplicator back to a recycle mode, the arm of the mode selection switch A will be shifted back to contact $\overline{A}$, i.e., to a "0" condition (with a subsequent actuation of gripper control button 404 whose action is subsequently explained). This will again cause the operation of the feeder release mechanism and the movement of the paper table downward (state 10). State 11 is an intermediate state in which the paper table is in an intermediate position, and state 12 represents the state that will be entered upon the paper table reaching a fully lowered position. In state 12, the recycle tray output signal RT will once again be actuated so as to cause the auxiliary paper tray transport to move the auxiliary paper tray 68 from an initial position above the normal paper tray back to the position wherein it is prepared to receive printed sheets from impression cylinder 14. State 13 is an intermediate state in which the transport rack is en-route between the out and inward positions, and state 14 is the state of the duplicator upon the arrival of the transport rack at the fully in position (indicated by the change in input D from a "0" condition level to a "1" condition). Upon the occurrence of this state, corner guides logic 422 will provide a start signal to motor control circuit 446, and paper table motor logic 420 will produce commands which will cause the paper table to begin movement back to an operating position. Once again, state 15 represents an intermediate state in which the corner guides and paper table have not yet reached their final destinations, and state 1 represents the state in which the duplicator is again fully prepared to operate in a recycle mode.

The combinational logic circuits 414 through 422 are essentially direct implementations of the truth table of FIG. 16. Since the derivation of combinational logic circuits of this nature is well known in the digital control art, only a cursory description of these circuits will be provided.

There is shown in FIG. 11 a schematic illustration of the feeder release logic circuit 414 which controls the enablement and disablement of the mechanical inching mechanism for the paper table. It will be seen that this logic circuit comprises AND gates 500 and 502 and a NOR gate 504 for logically combining the output signals provided by the AND gates. Although generally the combinational logic circuits serve to initiate a desired operation upon the occurrence of specified events, the feeder release logic circuit 414 of FIG. 11 serves instead to always actuate the feeder release mechanism except upon the occurrence of two events. These two events correspond to the two ending conditons, namely state 1 of the recycle mode and state 9 of the straight-through mode.

Recycle tray logic 416, shown more particularly in FIG. 12, operates in the more normal manner of actuating the recycle solenoid 432 in each of two states, the presence of which is determined by AND gates 506 and 508. OR gate 510 joins the logic signals provided by AND gates 506 and 508 to operate an emitter-follower arrangement 512 in accordance therewith. Emitter-follower 512 is included to provide adequate current gain for driving relay 428 at the output thereof.

Stripper bar and vacuum conveyor logic 418, shown more particularly in FIG. 13, operates in a similar manner to provide logic signals which control solenoid 114 and relay 438. Again, an emitter-follower arrangement 514 is included to provide adequate current gain for driving relay 438.

The paper table motor logic 420, shown more specifically in FIG. 14, is the most complex, since it requires the generation of three separate output signals, under six input conditions. These conditions are determined by six AND gates 520 through 530. AND gates 520, 522 and 524 determine when a state has been reached in which the table must be moved in an upward direction. Conversely, AND gates 526, 528 and 530 determine when the apparatus is in those states which require the paper table to be moved in a downward direction. Again, these separate conditions are joined by OR gates 532 and 534. AND gates 536 and 538 are included to insure that contradictory commands are not simultaneously supplied to the up and down control lines. Thus, the up control line can only supply a logic 1 output signal if the output of OR gate 532 indicates one of the specified conditions under which the paper table is to be moved up has occurred, and the output of OR gate 534 indicates that a condition has not been reached in which a down command is to be supplied. AND gate 538 provides a similar prohibition for the down command signal. The brake signal which must be supplied by paper table motor logic 420 is generated by gates 540, 542, and 544. These gates operate to provide a logic 1 output on the brake output line whenever both up and down outputs are at a logic "0" state.

The corner guides logic circuit 422 is illustrated more particularly in FIG. 15. As in all of the other combinational logic circuits, two AND gates 546 and 548 are included to determine when specified states have been reached. Gate 546 provides an output signal when that state has been reached in which the corner guides are to be moved in a downward direction, whereas gates 548 provides an output signal when that state has been reached in which the corner guides are to be moved in an upward direction. A filter circuit 550 is included to delay the supply of a start signal to the corner guides motor control circuit 446 when the corner guides are to be moved in an upward direction so that the motor control circuit 446 has time to respond to the change in the U/D command, derived by paper table motor logic 420, which changes at substantially the same time. The two conditions derived in this manner are joined by an OR gate 552 and then supplied to an emitter-follower 554. Emitter-follower 554 includes a differentiation network comprised of a capacitor 556 and a diode 558 so that the pulse provided by emitter-follower 554 is converted into a positive going pulse which is then supplied to the motor control circuit 446.

GRIPPER CONTROL

The circuitry which has thus far been described serves to control the operation of the paper table, the corner guides, the recycle tray slides, and the stripper bar and vacuum conveyor. An additional feature of the duplicator which must be controlled during a mode change is the action of the impression cylinder grippers which grip the paper as it passes through the printing nip. The circuitry for controlling the cam leaf 260 (FIG. 8) which determines when the paper is released by the grippers is illustrated in the bottom section of FIG. 10. The two elements which must be controlled are the gripper-set solenoid 264 which controls the position of the cam leaf 260 (FIG. 8), and the gripper-lock solenoid 292 which controls the position of the locking pin 290 (FIG. 9) which locks the leaf 260 in the outward position.

The operation of these two solenoids is accomplished by means of manually controlled push button switch 404, a switch 408 which is ganged with mode selection switch A, and switch 410 which is ganged with simplex/duplex selector switch 406. Every time the mode selection switch A is changed from one position to the other, the manually operable push button switch 404 must also be momentarily depressed so as to set the grippers in the appropriate position. Switch 404 is connected in series with a second switch 605 operable by a cam follower 607 which follows a main shaft cam 609. In this manner, the depressing of manually operable switch 404 will only produce a trigger signal to one-shot 602 when the main shaft cam is in a position wherein the cam follower 607 allows switch 605 to also be in a closed position. Consequently, the trigger signal will be supplied only at a time when the cam follower 262 which follows the cam 284 is in the appropriate position for shifting, i.e., not opposite the movable leaf. Upon triggering in this manner, one-shot 602 will provide a positive going pulse which will result in an actuation signal being supplied to both solenoids by respective driver circuits 606 and 608. A delay network 610 is included so as to insure that these control signals are supplied in the proper order. Therefore, this pulse will first produce the actuation of the gripper cam lock solenoid 292 which will cause the locking pin to be pulled into a retracted position. Shortly thereafter, the gripper cam set solenoid 264 will receive an actuation signal by driver 608 and will either be operated or not operated, depending upon the position of switches 408 and 410.

The position of switch 408 will depend upon the position of mode selection switch A, to which it is ganged. When mode selection switch is in the "straight-through" position shown, switch 408 will be closed, so that the actuation signal supplied by driver 608 will cause the gripper cam set solenoid 264 to be operated, thereby placing the cam leaf 260 in the outward position. Upon the termination of the pulse signal provided by one-shot 602, the gripper lock solenoid 292 will first be released, followed shortly thereafter by the gripper set solenoid 264. Since the gripper lock solenoid 292 is released first, the locking pin 290 will move into the hole in the cam leaf 260 and will fix it in the outward position. Consequently, when gripper set solenoid 264 is released shortly thereafter, the cam leaf 260 will remain in the outward position. The sheet which is gripped by the grippers will therefore be released at a comparatively early stage in the revolution of the impression cylinder 14, and will be picked up by the stripper bar 110 and deposited in the outer tray 64.

If, however, the mode selection switch is in a recycle mode position, i.e., with the arm on contact $\overline{A}$, then switch 410 would be open and the gripper-set solenoid 264 would not operate; the cam leaf 260 will therefore move to an inward position in response to the spring 268 when released by the locking pin 290, and will remain in this position. Therefore, as has been made clear previously with the cam leaf 260 in this position the paper will go to the auxiliary paper tray 68, rather than to the external paper bin 64.

SIMPLEXING OPERATION

Simplex/duplex selector switch 406 may be utilized to select a simplex condition of operation rather than the duplex condition which has been described. When switch 406 and switch 408 (which are ganged) are in the illustrated positions, there will be no interference with the described operation of the duplicator, and a duplex condition of operation will result. In order to place the duplicator in the simplex condition of operation, the mode selection switch A will first be placed in a recycle mode position (opposite that shown) so that paper will be fed from the paper table 26. The selector switch 406 will then be placed in the simplex (open) position. The stripper bar solenoid 114 will therefore remain deactuated. The stripper bar 110 will thus rest adjacent the impression cylinder and will guide the paper into the external paper bin. In order that the grippers will release the paper at the appropriate time, a bypass switch 410 is provided which is ganged with selector switch 406. When switch 406 is placed in the simplex or open position, switch 410 will close, thus bypassing switch 408 and allowing the gripper set solenoid 264 to respond to the actuation signal supplied by driver 608, even though switch 408 will be open. Consequently, when the gripper set switch 404 is operated, the gripper set solenoid 264 will respond to the actuation signal provided by driver 608 to position the cam leaf 260 in the outer position where it will be locked as previously described. The paper will then be released at the appropriate moment, will be stripped from the cylinder by stripper bar 110, and will be deposited in the external paper bin 64.

While the foregoing description represents substantially the equipment as presently constructed, it will be readily realized that modification of the control circuit for higher degrees of automation is possible and is contemplated within the scope of the present invention.

Although the invention has been described with respect to a preferred embodiment, it will be appreciated that a multitude of rearrangements and revisions may be made without departing from the spirit and scope of the present invention, as defined in the claims which follow.

What is claimed is:

1. A single head duplicator adapted to print on both sides of copy sheets with a minimum amount of operator involvement comprising:

a frame;

means on said frame providing a printing nip;

means defining a feed station from which copy sheets are delivered sequentially to said printing nip;

means defining a primary delivery station;

means defining a secondary delivery station;

an auxiliary delivery tray positionable either at said secondary delivery station or at said feed station;

a paper table for blank copy sheets;

means to move said paper table between a first position at said feed station and a second position remote from said feed station;

means for selectively inverting each individual sheet after it is printed on one side at said printing nip and delivering it to said secondary delivery station in an inverted orientation, or not inverting each individual sheet after it is printed at said printing nip and delivering it to said primary delivery station;

means to move said auxiliary receiving tray between said secondary delivery station and said feed station; and means for jogging sheets as they are received on said auxiliary receiving tray when said tray is at said secondary delivery station, said jogging means comprising a first jogger on said frame coacting with copy sheets on said tray to jog them in the delivery direction, a second jogger on said tray to jog the copy sheets in a direction transverse to the delivery direction, and drive means on said frame freely releasable from and engageable with said second jogger when said tray is moved away from or returned to said secondary delivery station.

2. A single head duplicator adapted to print on both sides of copy sheets with a minimum amount of operator involvement comprising:

a frame;

means on said frame providing a printing nip, said means providing a printing nip including an impression cylinder;

means defining a feed station from which copy sheets are delivered sequentially to said printing nip;

means defining a primary delivery station;

means defining a secondary delivery station;

an auxiliary delivery tray positionable either at said secondary delivery station or at said feed station;

a paper table for blank copy sheets;

means to move said paper table between a first position at said feed station and a second position remote from said feed station;

means for selectively inverting each individual sheet after it is printed on one side at said printing nip and delivering it to said secondary delivery station in an inverted orientation, or not inverting each individual sheet after it is printed at said printing nip and delivering it to said primary delivery station, said means for selectively inverting or not inverting the sheets comprising gripper means on said impression cylinder, and first and second strippers adjacent said impression cylinder and respectively located adjacent said primary and secondary delivery stations, said first stripper being movable between active and inactive positions; and means to move said auxiliary receiving tray between said secondary delivery station and said feed station.

3. A duplicator as set forth in claim 2 further including means to activate said gripper means adjacent the nip to grip individual sheets of paper against the impression cylinder and carry such sheets thereon, and means to selectively deactivate said first stripper and deactivate said gripper means when adjacent the second stripper where said sheets are stripped from the impression cylinder, or activate said first stripper and deactivate said gripper means when adjacent said first stripper so that said sheets are fed directly from said printing nip to said primary delivery station.

4. A single head duplicator adapted to print on both sides of copy sheets with a minimum amount of operator involvement comprising:

a frame;

means on said frame providing a printing nip, said means providing a nip including an impression cylinder;

means defining a feed station from which copy sheets are delivered sequentially to said printing nip;

means defining a primary delivery station;

means defining a secondary delivery station;

an auxiliary delivery tray positionable either at said secondary delivery station or at said feed station;

a paper table for blank copy sheets;

means to move said paper table between a first position at said feed station and a second position remote from said feed station, said means to move the paper table comprising means to raise and lower the paper table;

means for selectively inverting each individual sheet after it is printed on one side at said printing nip and delivering it to said secondary delivery station in an inverted orientation, or not inverting each individual sheet after it is printed at said printing nip and delivering it to said primary delivery station, said means for selectively inverting the sheets comprising gripper means on said impression cylinder, and first and second strippers adjacent said primary and secondary delivery stations, said first stripper being movable between active and inactive positions, and further including means to activate said gripper means adjacent the nip to grip individual sheets of paper against the impression cylinder and carry such sheets thereon, and means to selectively deactivate said first stripper and deactivate said gripper means when adjacent the second stripper where said sheets are stripped from the impression cylinder, or activate said first stripper and deactivate said gripper means when adjacent said first stripper so that said sheets are fed directly from said printing nip to said primary delivery station; and means to move said auxiliary receiving tray between said secondary delivery station and said feed station, said means to move said auxiliary receiving tray comprising means to shift said tray horizontally between its receiving position and a position overlying said paper table so as to be raisable to and lowerable from said feed station by being carried upon said paper table as said paper table is raised and lowered.

5. A single head duplicator adapted to print on both sides of copy sheets with a minimum amount of operator involvement comprising:

a frame;

means on said frame providing a printing nip, said means providing a printing nip including an impression cylinder;

means defining a feed station from which copy sheets are delivered sequentially to said printing nip;

means defining a primary delivery station;

means defining a secondary delivery station;

an auxiliary delivery tray positionable either at said secondary delivery station or at said feed station;

a paper table for blank copy sheets;

means to move said paper table between a first position at said feed station and a second position remote from said feed station;

means for selectively inverting each individual sheet after it is printed on one side at said printing nip and delivering it to said secondary delivery station in an inverted orientation, or not inverting each individual sheet after it is printed at said printing nip and delivering it to said primary delivery station, said means for selectively inverting the sheets comprising gripper means on said impression cylinder, and first and second strippers adjacent said primary and secondary delivery stations, said first stripper being movable between active and inactive positions, and further including means to activate said gripper means adjacent the nip to grip individual sheets of paper against the impression cylinder and carry such sheets thereon, and means to selectively deactivate said first stripper and deactivate said gripper means when adjacent the second stripper where said sheets are stripped from the impression cylinder, or activate said first stripper and deactivate said gripper means when adjacent said first stripper so that said sheets are fed directly from said printing nip to said primary delivery station; and means to move said auxiliary receiving tray between said secondary delivery station and said feed station; and means for jogging sheets as they are received on said auxiliary receiving tray when said tray is at said secondary delivery station, said jogging means comprising a first jogger on said frame coacting with copy sheets on said tray to jog them in the delivery direction, a second jogger on said tray to jog the copy sheets in a direction transverse to the delivery direction, and drive means on said frame freely releasable from and engageable with said second jogger when said tray is moved away from or returned to said secondary delivery station.

6. A method of duplex duplicating using a single head duplicator having a printing nip between a printing cylinder and an impression cylinder, a paper table for copy paper sheets which is capable of being placed in and withdrawn from a feed station, an external paper receiver at a primary delivery station, a secondary delivery station, a controlled gripping and stripping apparatus and an auxiliary delivery and feed tray, which method comprises the steps of:

placing the paper table in the feed station with copy paper sheets thereon;

feeding copy paper sheets sequentially from the paper table to the printing nip to print on the first side of each sheet;

gripping each sheet against the impression cylinder after it has been printed on the first side;

rotating each once-printed sheet with the impression cylinder to invert each once-printed sheet;

ungripping and stripping each once-printed sheet from the impression cylinder after it has been inverted;

sequentially depositing each ungripped and stripped sheet in the auxiliary delivery and feed tray at the second delivery station;

withdrawing the paper table from the feed station;

thereafter mechanically shifting the tray from the second delivery station to the feed station;

feeding the previously deposited sheets sequentially from the tray to the printing nip for printing on the other side of each sheet; and stripping each sheet from the impression cylinder and depositing it in the external paper receiver after it has been printed on the other side.

7. A method as claimed in claim 6 in which the apparatus also includes means for mechanically lowering and raising the paper table, and in which the step of placing the paper table in the feed station comprises mechanically raising the paper table, the step of withdrawing the paper table from the feed station comprises mechanically lowering the paper table, and in which the step of mechanically shifting the tray comprises mechanically translating the tray from the auxiliary delivery station to a location above the lowered paper table and then partially raising the paper table with the tray thereon until the tray reaches the feed station.

* * * * *